US005238900A

United States Patent [19]

Shuku

[11] Patent Number: 5,238,900

[45] Date of Patent: Aug. 24, 1993

[54] HEAT-SENSITIVE RECORDING MATERIAL

[75] Inventor: Sigekazu Shuku, Nara, Japan

[73] Assignee: Kanzaki Paper Manufacturing Co., Ltd., Tokyo, Japan

[21] Appl. No.: 917,160

[22] Filed: Jul. 20, 1992

[30] Foreign Application Priority Data

Jul. 31, 1991 [JP] Japan ..... 3-192079

[51] Int. Cl.[5] ..... B41M 5/40

[52] U.S. Cl. ..... 503/207; 427/152; 503/200; 503/226

[58] Field of Search ..... 503/200, 207, 226; 427/152

[56] References Cited

U.S. PATENT DOCUMENTS 4,740,495 4/1988 Marinelli et al. ..... 503/200
4,812,438 3/1989 Yamori et al. ..... 503/200
4,948,775 8/1990 Tsuji et al. ..... 503/207

*Primary Examiner*—Pamela R. Schwartz
*Attorney, Agent, or Firm*—Morgan & Finnegan

[57] ABSTRACT

The heat-sensitive recording material is prepared by forming on a support successively a heat-sensitive recording layer containing a color former and a color developer which forms a color by reacting with the color former, an intermediate layer obtained by coating an aqueous solution or aqueous dispersion of a resin, and an overcoat layer containing a ionizing radiation curable resin, and then irradiating an ionizing radiation. The overcoat layer contains a silicone surface active agent and a low molecular weight polyolefin resin microball. The heat-sensitive recording material is excellent in recording runnability and printability as well as in color density of the recorded images and image-retainability.

5 Claims, No Drawings

HEAT-SENSITIVE RECORDING MATERIAL

BACKGROUND OF THE INVENTION

This invention relates to a heat-sensitive recording material which has an overcoat layer containing a resin curable upon exposure to an ionizing radiation (hereinafter, referred to as "ionizing radiation curable resin"), and particularly to a heat-sensitive recording material which is high in gloss, excellent in color density of the recorded images and image-retainability, and further excellent in recording runnability and printability.

There has been known heat-sensitive recording materials utilizing the color forming reaction between a color former and a color developer, in which the two color forming materials are thermally contacted each other to produce recorded images. These heat-sensitive recording materials are comparatively inexpensive and can be used on a recording equipment which is compact and requires fairly easy maintenance. Because of these advantages, the heat-sensitive recording materials have been used not only as the recording medium of facsimiles and various computers, but also in the other various fields such as heat-sensitive labels. However, one major problem with heat-sensitive recording materials is their low resistance to fingerprints or solvents. If the recording layer comes in contact with a sebum of human being or a solvent, the color density of the recorded images is decreased or an unwanted coloration called "background fogging" occurs.

With a view of solving the problem, several methods have been proposed; in one method, an aqueous emulsion of a resin having film-forming properties and resistance to chemicals is coated on a heat-sensitive recording layer (Japanese Laid-Open Patent Publication No. 128,347 of 1979); and in another method, a water-soluble high molecular weight compound such as polyvinyl alcohol is coated on a heat-sensitive recording layer (Japanese Laid-Open Utility Model Publication No. 125,354 of 1981). However, the methods so far either suffer from additional problems or find themselves incapable of achieving the intended results to satisfactory levels.

For instance, in the method in which an aqueous resin coating is applied to a heat-sensitive recording layer, the temperature for drying has to be limited to a certain level in order to avoid unwanted coloration of the recording layer due to high temperature drying, whereby curing of the resin layer inevitably becomes insufficient for preventing its sticking to a recording head during recording. In order to avoid this problem, there is proposed a method in which a resin component capable of curing upon exposure to electron beams is coated on a heat-sensitive recording layer and the coated resin component is cured upon exposure to electron beams. However, the resulting heat-sensitive recording material is still unsatisfactory in terms of the image-retainability. In addition, there may also be problems that the electron beam-curable resin layer causes coloration of the heat-sensitive recording layer just after it has been coated or causes fading of the recorded images.

Under these circumstances, we, inventors, had investigated on the improvement of these difficulties and had found that, when an intermediate layer containing an aqueous resin was formed on the heat-sensitive recording layer and then an overcoat layer containing an electron beam-curable resin was formed on it, a heat-sensitive recording material which had an improved image-retainability with no fogging of the recording layer and also widely varying surface characteristics and which was superior in recording characteristics could be obtained (Japanese Patent Publication No. 42,835 of 1989). However, this proposal gave no sufficient result in the recording runnability.

Recently, the heat-sensitive recording materials have been widely used as the labels for commercial goods and, particularly in the case it is recorded in a high speed, for example, in a full-automatic labeller, an adhesion of the recording head to the overcoat layer during recording becomes a serious problem. In this case, as a method for preventing the sticking (adhesion) between the recording head and the overcoat layer, it may be considered to adding a silicone leveling agent in the overcoat layer. However, it has been found that, though the silicone leveling agent prevents sticking to some extent, it lowers printability. For example, it deteriorates the transfer of ink during printing or lowers the adhesion of ink to the recording material so that a sufficient printing effect can not be obtained.

Therefore, an object of the invention is to dissolve the above problems to provide a heat-sensitive recording material which has an overcoat layer comprising a ionizing radiation curable resin on the heat-sensitive recording layer and which is excellent in recording runnability and printability as well as in color density of the recorded images and image-retainability.

SUMMARY OF THE INVENTION

The heat-sensitive recording material according to the invention is prepared by forming on a support successively a heat-sensitive recording layer containing a color former and a color developer which forms a color by reacting with the color former, an intermediate layer obtained by coating an aqueous solution or aqueous dispersion of a resin, and an overcoat layer containing a ionizing radiation curable resin, and then irradiating an ionizing radiation. The overcoat layer contains a silicone surface active agent and a low molecular weight polyolefin resin microball.

DETAILED DESCRIPTION OF THE INVENTION

There is no particular limitation on the possible combination of color developers that are to be incorporated in the heat-sensitive recording layer of the invention, and any combination that undergoes a coloring reaction as a result of contact between the both coloring materials by the action of heat may be employed. Illustrative combinations are those of colorless or pale-colored basic dyes and inorganic or organic acidic substances, and those of metal salts of higher fatty acids (e.g., ferric stearate) and phenols (e.g., gallic acid).

Particularly good results are attained in terms of recording characteristics when the overcoat layer specified herein is used with the combination of a basic dye and an acidic substance.

As the basic dye, there may be used various known colorless or pale-colored basic dyes, such as triarylmethane dyes, e.g., 3,3-bis(p-dimethylaminophenyl)-6-diemthylaminophthalide, 3,3-bis(p-dimethylaminophenyl)phthalide and 3-p-dimethylaminophenyl-3-(1-methylpyrrole-3-yl)-6-dimethylaminophthalide; diphenylmethane dyes, e.g., 4,4'-bis-dimethylaminobenzhydrylbenzylether, N-halophenyl-leucoauramine and N-2,4,5-trichlorophenyl-leucoauramine; thiazine dyes, e.g., benzoyl-leucomethylene blue and p-nitrobenzoyl-leucomethylene blue; spiro dyes, e.g., 3-methyl-spiro-dinaphthopyran, 3-ethyl-spiro-dinaphthopyran, 3-phenyl-spiro-dinaphthopyran, 3-benzyl-spiro-dinaphthopyran, 3-methyl-naphtho(6'-methoxybenzo)spiropyran and 3-propyl-spirodibenzopyran; lactam dyes, e.g., Rhodamine B-anilinolactam, rhodamine(p-nitroanilino)lactam and rhodamine(o-chloroanilino)-lactam; fluoran dyes, e.g., 3-dimethylamino-7-methoxy-fluoran, 3-diethylamino-6-methoxyfluoran, 3-diethylamino-7-methoxyfluoran, 3-diethylamino-7-chloro-fluoran and 3-pyrrolidino-6-methyl-7-p-butyl-phenylaminofluoran; and colorless and pale-colored basic dyes described in Japanese Laid-Open Patent Publication No. 79,387 of 1991.

As the acidic substance, there may be used various known inorganic or organic acidic substances as a color developer which forms a color upon contact with the colorless or pale-colored basic dye; for example, inorganic acidic substances such as activated clay, acid clay, attapulgite, bentonite, colloidal silica and aluminum silicate; and organic acidic substances such as 4-tert-butylphenol, 4-hydroxydiphenoxide, α-naphthol, β-naphthol, and 4-hydroxyacetophenol; and color developers described in Japanese Laid-Open Patent Publication No. 79,387 of 1991.

The proportion of the color former to the color developer used in the recording layer according to the invention is not limited to any particular values and may be appropriately selected in accordance with the types of color former and developer employed. For example, in the case of that a colorless or pale-colored basic dye and an acidic substance are used, generally 1 to 50 parts by weight, preferably 1 to 10 parts by weight, of the acidic substance may be used per part by weight of the basic dye. A coating composition containing these substances may be prepared by dispersing color former and developer, either as an admixture or independently, in a dispersion medium, which is typically water, by means of a suitable stirrer or grinder such as a ball mill, an attritor, or a sand mill.

The coating composition may contain a binder in an amount of 10 to 40 weight %, preferably 15 to 30 weight %, based on the total solids content of the coating composition. As the binder, there is exemplified starches, hydroxyethyl cellulose, methyl cellulose, carboxymethyl cellulose, gelatin, casein, gum arabic, polyvinyl alcohol, diisobutylene-maleic anhydride copolymer salts, styrene-maleic anhydride copolymer salts, ethylene-acrylic acid copolymer salts, styrene-acrylic acid copolymer salts and styrene-butadiene copolymer emulsions.

The coating composition may further contain various additives such as dispersing agents, e.g., sodium dioctyl-sulfosuccinate, sodium dodecylbenzenesulfonate, sodium lauryl sulfate, alginates and metal salts of fatty acids; ultraviolet absorbers, e.g., benzophenones and triazol compounds; defoaming agents; fluorescent dyes; and coloring dyes.

Further, there may be added, if necessary, in the coating composition such as lubricants, e.g., zinc stearate, calcium stearate, polyethylene wax, carnauba wax, paraffin wax and ester waxes; inorganic pigments, e.g., kaolin, clay, talc, calcium carbonate, calcined clay, titanium oxide, diatomaceous earth, fine granular anhydrous silica and activated clay; and sensitizers, e.g., stearic amide, stearic methylenebisamide, oleic amide, palmitic amide, sperm oleic amide and coconut oil fatty amide.

As the support, papers such as wood free papers, art papers, and coated papers; plastic films such as polyethylene, polypropylene, polyester, polyvinyl chloride, polystyrene and nylon films; sheets prepared by laminating plastic to paper; and synthetic papers prepared by a film method or a fiber method can be used.

A method for forming the recording layer is not particularly limited. Any known conventional coating methods may be used. For instance, it can be formed by applying the coating composition on a support by such methods as bar coating, air-knife coating, rod blade coating, pure blade coating and short-dwell coating and then drying it. In the case of that a plastic film is used as the support, the coating efficiency can be increased by irradiating corona discharge or electron beam on the surface. The amount of the coating composition is not particularly limited, but it is generally within the range of 2 to 12 g/m$^2$, preferably 3 to 10 g/m$^2$, on dry basis.

In accordance with the invention, on the heat-sensitive recording layer a coating composition comprising an aqueous solution or aqueous dispersion of a resin is applied to form an intermediate layer. As the resins used in the aqueous solution, namely water-soluble resins for the intermediate layer, there are exemplified completely or partly saponified polyvinyl alcohols; acetoacetylated polyvinyl alcohols in which an acetoacetyl group has been introduced by reacting a polyvinyl alcohol with diketene or the like; reaction products of a polyvinyl alcohol with polycarboxylic acids such as fumaric acid, phthalic anhydride, trimellitic anhydride and itaconic anhydride, or esterified products of these reaction products; carboxy-modified polyvinyl alcohols obtained as saponification products of copolymers of vinyl acetate and ethylenically unsaturated carboxylic acids such as maleic acid, fumaric acid, itaconic acid, crotonic acid, acrylic acid and methacrylic acid; sulfonic acid-modified polyvinyl alcohols obtained as saponification products of copolymers of vinyl acetate and olefinic sulfonic acids such as ethylenesulfonic acid and allylsulfonic acid or salts thereof; olefin-modified polyvinyl alcohols obtained by saponifying copolymers of vinyl acetate and olefins such as ethylene, propylene, isobutylene, α-octene, α-dodecene and α- octadodecene; nitrile-modified polyvinyl alcohols obtained as saponification products of copolymers of vinyl acetate and nitriles such as acrylonitrile and methacrylonitrile; amide-modified polyvinyl alcohols obtained by saponifying copolymers of vinyl acetate and amides such as acrylamide and methacrylamide; pyrrolidone-modified polyvinyl alcohols obtained by saponifying copolymers of vinyl acetate and N-vinylpyrrolidone; cellulose derivatives such as methyl cellulose, ethyl cellulose, hydroxyethyl cellulose and carboxymethyl cellulose; casein; gum arabic; and starches such as oxidized starch, etherified starch, dialdehyde starch and esterified starch.

Further, as the aqueous dispersions for forming the intermediate layer, there are exemplified styrene-butadiene copolymer emulsions; vinyl acetate-vinyl chloride-ethylene copolymer emulsions; and methacrylate-butadiene copolymer emulsions.

Among the above resins, various modified polyvinyl alcohols, cellulose derivatives and casein are preferable and acetoacetylated polyvinyl alcohols and carboxy-modified polyvinyl alcohols are most preferable.

Furthermore, it is preferable to add pigments in the intermediate layer in order to increase its smoothness and adhesion to the overcoat layer by anchoring effect. As the pigments, there are exemplified inorganic pigments such as calcium carbonate, zinc oxide, aluminum oxide, titanium dioxide, silicon dioxide, aluminum hydroxide, barium sulfate, zinc sulfate, talc, kaolin, clay, calcined clay and colloidal silica; and organic pigments such as polystyrene microballs, nylon powder, polyethylene powder, urea-formaldehyde resin filler and raw starch granules. These pigments are generally incorporated in the intermediate layer in an amount of 5 to 500 parts by weight, preferably 80 to 350 parts by weight, based on 100 parts by weight of the resin component.

In addition, the coating composition for forming the intermediate layer may optionally contain a curing agent such as glyoxal, methylolmelamine, potassium persulfate, ammonium persulfate, sodium persulfate, ferric chloride, magnesium chloride, boric acid, and ammonium chloride. If necessary, the coating composition may further contain various additives such as lubricants, e.g., zinc stearate, calcium stearate, stearic amide, polyethylene wax, carnauba wax, paraffin wax and ester waxes; surface active agents, e.g., sodium dioctylsulfosuccinate, sodium dodecylbenzene-sulfonate, sodium lauryl sulfate, alginic acid salts and metal salts of fatty acids; ultraviolet absorbers, e.g., benzophenone and triazole compounds; defoaming agents; fluorescent dyes; and coloring dyes.

The coating composition for forming the intermediate layer is generally prepared as an aqueous composition and, after optional mixing by means of a suitable mixing or stirring apparatus such as a mixer, an attritor, a ball mill, or a roll mill to obtain a desired dispersion, the coating composition is applied onto the heat-sensitive recording layer by any known coating methods. After its application, the intermediate layer may be dried by exposure to ultraviolet rays or electron beams. If a curing agent is used in combination, it may be either incorporated in the coating composition for forming the intermediate layer, or coated separately from the coating composition for forming he intermediate layer. The latter method has an advantage of permitting a strong curing agent to be selected without worrying about the pot life of the coating composition.

The coated amount of the coating composition for forming the intermediate layer is not particularly limited. However, if the coating composition is applied in an amount of less than 0.1 $g/m^2$, the intended effects of the invention are not fully attained, and if the coating composition is applied in an amount exceeding 20 $g/m^2$, the recording sensitivity of the resulting heat-sensitive recording material may be reduced remarkably. Therefore, the coating composition for the intermediate layer is generally applied in an amount of 0.1 to 20 $g/m^2$, preferably 0.5 to 10 $g/m^2$, on dry basis.

Further, a coating layer similar to the intermediate layer may be formed, if necessary, on the back side of the heat-sensitive recording material to more improve the image-retainability. Any of the processing techniques known in the art of manufacturing heat-sensitive recording materials may additionally performed. For instance, a primer layer may be formed on a support; or an adhesive may be applied to the backside of the recording material so as to make an adhesive label.

As a recording material superior in gloss and density of the recorded images can be obtained by enhancing the surface smoothness of the intermediate layer, it is preferable to smooth it with such as a supercalender. The Bekk smoothness of the intermediate layer is preferably adjusted to not less than 500 seconds, more preferably not less than 1600 seconds, in the case of that the support is a plastic film or a synthetic paper, and to not less than 50 seconds, more preferably not less than 300 seconds, in the case of that the support is paper.

In the heat-sensitive recording material of the invention, the intermediate layer thus formed is overcoated with an overcoat layer containing a ionizing radiation curable resin, a silicone surface active agent and a low molecular weight polyolefin microballs.

As the useful ionizing radiation curable resins, there are exemplified the following prepolymers and monomers.

Among the prepolymers, there are included such as (a) poly(meth)acrylates of aliphatic, alicyclic or aromatic polyhydric alcohols (having 2 to 6 alcoholic hydroxyl groups) or polyalkylene glycols; (b) poly(meth-)acrylates of polyhydric alcohols obtained by addition of alkylene oxides to aliphatic, alicyclic or aromatic polyhydric alcohols (having 2 to 6 alcoholic hydroxyl groups); (c) poly(meth)acryloyloxyalkyl phosphates; (d) polyester poly(meth)acrylates; (e) epoxy poly(meth-)acrylates; (f) polyurethane poly(meth)acrylates; (g) polyamide poly(meth)acrylates; (h) polysiloxane poly(meth) acrylates; (i) low molecular weight vinyl or diene polymers containing (meth)acryloyloxy group in the side chain and/or terminal thereof; and (j) modified products of oligoester (meth) acrylates of (a) to (i) above.

Among the monomers, there are included such as (a) carboxyl group-containing monomers exemplified by ethylenically unsaturated mono- or polycarboxylic acids, and salts thereof, such as alkali metal salts, ammonium salts and amine salts; (b) amide group-containing monomers exemplified by ethylenically unsaturated (meth)acrylamides or alkyl-substituted (meth)acrylamides, and vinyl lactams such as N-vinylpyrrolidone; (c) sulfonic acid group-containing monomers exemplified by aliphatic or aromatic vinylsulfonic acids, and salts thereof, such as alkali metal salts, ammonium salts and amine salts; (d) hydroxyl group-containing monomers exemplified by ethylenically unsaturated ethers of polyols, and (meth)acrylate esters of polyhydric alcohols; (e) amino group-containing monomers such as dimethylaminoethyl (meth) acrylate-2-vinylpyridine; (f) quaternary ammonium salt group-containing monomers; (g) alkyl esters of ethylenically unsaturated carboxylic acids; (h) nitrile group-containing monomers such as (meth)acrylonitrile; (i) styrene; (j) ethylenically unsaturated alcohol esters such as vinyl acetate and (meth)allyl acetate; (k) mono(meth)acrylates of alkylene oxide adducts of active hydrogen-containing compounds; (l) ester group-containing polyfunctional monomers exemplified by di- or polyesters of polybasic acids and unsaturated alcohols; (m) polyfunctional monomers comprising di- or polyesters of alkylene oxide adducts of active hydrogen-containing compounds with (meth) acrylic acid; (n) bisacrylamides such as N,N-methy lenebisacrylamide; (o) difunctional monomers such as divinylbenzene, divinylethylene glycol, divinylsulfone, divinyl ether, and divinyl ketone; and (p) polyfunctional unsaturated monomers such as trivinylbenzene.

The above ionizing radiation curable resins may be used either solely or in combination.

As described above, the heat-sensitive recording material of the invention is characterized by that the overcoat layer contains at least a silicone surface active agent and a low molecular weight polyolefin microballs in addition to a ionizing radiation curable resin. The desired effect of the invention can be attained by the combination of the silicone surface active agent and the microballs.

Thus, though the reason is not necessarily clear, an excellent recording runnability can be attained by a procedure in which the silicone surface active agent covers the surface of the low molecular weight polyolefin microballs in the layer of the ionizing radiation curable resin. The covering power of the silicone surface active agent depends on the molecular weight, particle size and molecular weight of the polyolefin microball, and the molecular weight and structure of raw material olefin, and the proportion of the silicone surface active agent and the low molecular weight polyolefin microballs. Particularly, if the molecular weight of polyolefin microball is excessively large, the covering power of the silicone surface active agent decreases remarkably. Therefore, it is preferable that the molecular weight of the low molecular weight polyolefin microball used in the invention is within a specified range. The preferred range of the molecular weight is a low molecular weight range of 1,000 to 10,000. At a molecular weight of lower than 1,000, the polyolefin may be difficult to be made to microball. If the molecular weight is higher than 10,000, the covering power of the silicone surface active agent is decreased as mentioned above and the desired effect of the invention may not be obtained.

The preferred olefins as the raw material of polyolefin microball are those having 2 to 4 carbon atoms such as ethylene, propylene, butylene and vinyl acetate. Among them, particularly preferred are ethylene and propylene.

As the preferable method for preparing microballs, there is exemplified a method in which polyethylene wax is subjected to a shear at a high temperature under a high pressure, dispersed forcedly in an aqueous solution of potassium hydroxide and dried to prepare pulverized sphere particles (High temperature high pressure high shear aqueous KOH solution dispersion process). Microballs prepared by freeze-pulverizing process have hardly sphere particle forms and therefore do not necessarily give a heat-sensitive recording material sufficient in recording runnability and image quality in comparison with the above High temperature high pressure high shear aqueous KOH solution dispersion process. A too large particle size of the wax lowers the gloss and recording density of the heat-sensitive recording material and a particle size of 0.5 to 7 microns is preferred. In the invention, low molecular weight polyolefin microballs prepared by the high temperature high pressure high shear aqueous KOH solution dispersion process are preferably used.

Among the useful silicone surface active agents, there are included such as copolymers of dialkylsiloxane with a polymer or copolymer comprising oxyalkylene and/or alkylene units; and copolymer of dialkylsiloxane with siloxanes in which an alkyl and a polymer or copolymer having oxyalkylene and/or alkylene units are bonded to Si atom. They are generally liquids at room temperature.

The content of the silicone surface active agent is controlled to preferably 0.01 to 5 weight %, more preferably 0.01 to 3 weight %, most preferably 0.01 to 1 weight % based on the amount of ionizing radiation curable resin. The recording runnability may be lowered when the content is lower than 0.01 weight %, while the printability may become poor when the content is higher than 5 weight %.

On the other hand, the content of the low molecular weight polyolefin microballs is preferably controlled to 0.05 to 10 weight %, more preferably 0.1 to 5 weight % based on the amount of ionizing radiation curable resin. The recording runnability may be lowered when the content is lower than 0.05 weight %, while the preservability of the resulting recording material tends to be lowered when the content is higher than 10 weight %.

In the invention, if required, various inorganic pigments such as calcium carbonate and titanium dioxide; pigments prepared by treating inorganic pigments with organic acids; organic pigments such as benzoguanamine resin powder and raw starch powder; and additives such as resins which cannot be cured by ionizing radiation, defoamers, non-silicone type leveling agents, lubricants, surface active agents, plasticizers and ultraviolet absorbers may be appropriately added in the overcoat layer within the range of not deteriorating the effect of the invention in addition to the ionizing radiation curable resin, the silicone surface active agent and the low molecular weight polyolefin microballs. As the resins which cannot be cured by ionizing radiation, there are exemplified acrylic resins, silicone resins, alkyd resins, fluorine-contained resins and butyral resins.

The coating composition for forming the overcoat layer comprising the above resin components and microballs is completely mixed with a proper mixer or stirrer and then applied on the above-mentioned intermediate layer by any of various known methods. If necessary, the resin components may be heated to control the viscosity. The amount of application is not particularly limited, but generally it is preferred to be controlled in the range of 0.1 to 20 g/m$^2$, more preferably 1 to 10 g/m$^2$. In the case of less than 0.1 g/m$^2$, the desired effect of the invention may not be expected. On the other hand, an application of higher than 20 g/m$^2$ tends to lower the recording sensitivity of the resulting recording material.

The overcoat layer thus formed on the intermediate layer is cured by an irradiation of an ionizing radiation rays. The ionizing radiation rays are exemplified by electron beam, ultraviolet ray, $\alpha$ ray, $\beta$ ray, $\gamma$ ray, X ray and neutron ray. As $\alpha$ ray, $\beta$ ray, $\gamma$ ray and X ray are dangerous to the human body, electron beam and ultraviolet ray both low in danger and easy in handling are preferable used.

For example, when electron beam is used, the dose of electron beam irradiated is preferably in the range of 0.1 to 15 Mrad, more preferably form 0.5 to 10 Mrad. A dose less than 0.1 Mrad may not fully cure the ionizing radiation curable resin component. On the other hand, an excessive dose of electron beam higher than 15 Mrad tends to cause color development and discoloration of the heat-sensitive recording material, and further, in the case the support is a paper, it tends to cause a lowering of paper strength. The methods of electron beam irradiation include, for example, scanning process, curtain beam process and broad beam process. A suitable accelerating voltage for irradiation is about 100 KV to about 300 KV.

On the other hand, when ultraviolet ray is used, it is necessary to incorporate a sensitizer in the coating composition. It is added in the range of 0.2 to 10 weight %, preferably 0.5 to 5 weight %, based on the ultraviolet curable resin component. As the light source for irradiating ultraviolet ray, 1 to 50 pieces of ultraviolet lamps, xenon lamps or tungsten lamps are used. An ultraviolet ray having an intensity of 40 to 200 W/cm is preferably irradiated.

As the sensitizer, there are exemplified thioxanthone, benzoin, benzoin alkyl ether xanthone, dimethylxanthone, benzophenone, anthracene, 2,2-diethoxyacetophenone, benzyldimethylketal, benzyldiphenyldisulfide, anthraquinone, 1-chloroanthraquinone, 2-ethylanthraquinone, 2-tertbutylanthraquinone, N,N'-tetraethyl-4,4'-diaminobenzophenone and 1,1'-dichloroacetophenone.

The above-mentioned electron beam irradiation process is higher in productivity than a ultraviolet irradiation process. It involves no difficulty of odor and color development due to the addition of a sensitizer and gives a uniform crosslinked structure and thus it is used most preferably.

The heat-sensitive recording material of the invention having overcoat layer thus prepared may be further treated by such as super calender to improve the recording density and its unevenness.

PREFERRED EMBODIMENTS OF THE INVENTION

The following examples serve to illustrate the invention in more detail although the invention is not limited to the examples. Unless otherwise indicated, parts and % signify parts by weight and % by weight, respectively.

Polyolefin microballs (A to I) is used in the examples are shown in Table 1.

TABLE 1

| | Raw material olefin | Microball Molecular weight | Microball Particle size (μm) |
|---|---|---|---|
| A | Ethylene | 4000 | 4 |
| B | Ethylene | 2000 | 4 |
| C | Ethylene | 9000 | 4 |
| D | Ethylene | 4000 | 1 |
| E | Ethylene | 4000 | 6 |
| F | Ethylene | 4000 | 10 |
| G | Ethylene | 12000 | 4 |
| H | Ethylene + propylene | 9000 | 4 |
| I | Ethylene + vinyl acetate | 9000 | 4 |

EXAMPLE 1

(1) Preparation of Dispersion A

The following composition was pulverized by a sand mill until an average particle size of 3 microns.

| | |
|---|---|
| 3-(N-cyclohexyl-N-methylamino)-6-methyl-7-phenylaminofluorane | 10 parts |
| Methyl cellulose (5% aqueous solution) | 5 parts |
| Water | 30 parts |

(2) Preparation of Dispersion B

The following composition was pulverized by a sand mill until an average particle size of 3 microns.

| | |
|---|---|
| Benzyl 4-hydroxybenzoate | 20 parts |
| Methyl cellulose (5% aqueous solution) | 5 parts |
| Water | 55 parts |

(3) Preparation of Recording Layer 45 parts of Dispersion A, 80 parts of Dispersion B, 50 parts of a 20% aqueous solution of oxidized starch, and 10 parts of water were mixed under agitation to make a coating composition. The coating composition was coated on base paper of 50 g/m$^2$ in the weight of an amount of 6 g/m$^2$ on dry basis and dried to form a heat-sensitive recording layer on the base sheet.

(4) Formation of Intermediate Layer

A coating composition consisting of the following components was coated on thus obtained recording layer in the weight of an amount of 4 g/m$^2$ on dry basis, dried and treated by a super-calender to obtain an intermediate layer having a Bekk smoothness of 500 seconds.

| | |
|---|---|
| 8% aqueous solution of acetoacetylated polyvinyl alcohol (Trade name: Z-200, made by Nippon Gosei Kagaku K.K.) | 1,000 parts |
| Calcium carbonate (Trade name: Softon 1800, made by Bihoku Hunka K.K.) | 100 parts |
| Water | 100 parts |

(5) Formation of Overcoat Layer

A mixture of the following components was coated on thus obtained intermediate layer in the weight of 3 g/m$^2$ on dry basis.

| | |
|---|---|
| Aclyrate prepolymer (condensation product of epichlorohydrinhexanediol polymer with acrylic acid) | 100 parts |
| silicone surface active agent (Trade name: X-24-8301S, made by Shin-etsu Kagaku Kogyo K.K.) | 0.1 parts |
| Microball A shown in Table 1 | 1 part |

Then the coated layer was exposed to an electron beam (total dose: 3 Mrad) with an electron curtain-type electron beam irradiator (Model CB-150 manufactured by ESI Corporation) to cure the resin and to obtain a heat-sensitive recording material with an overcoat layer.

EXAMPLE 2

A heat-sensitive recording material was prepared in the same manner as an Example 1 except that Microball B shown in Table 1 was used instead of Microball A.

EXAMPLE 3

A heat-sensitive recording material was prepared in the same manner as in Example 1 except that Microball C shown in Table 1 was used instead of Microball A.

EXAMPLE 4

A heat-sensitive recording material was prepared in the same manner as in Example 1 except that Microball H shown in Table 1 was used instead of Microball A.

EXAMPLE 5

A heat-sensitive recording material was prepared in the same manner as in Example 1 except that Microball I shown in Table 1 was used instead of Microball A.

EXAMPLE 6

A heat-sensitive recording material was prepared in the same manner as in Example 1 except that 2 parts of the silicone surface active agent and 5 parts of Microball A were used.

EXAMPLE 7

A heat-sensitive recording material was prepared in the same manner as in Example 1 except that 0.02 part of the silicone surface active agent and 0.1 part of Microball A were used.

EXAMPLE 8

A heat-sensitive recording material was prepared in the same manner as in Example 1 except that Microball E shown in Table 1 was used instead of Microball A.

EXAMPLE 9

A heat-sensitive recording material was prepared in the same manner as in Example 1 except that Microball D shown in Table 1 was used instead of Microball A.

COMPARATIVE EXAMPLE 1

A heat-sensitive recording material was prepared in the same manner as in Example 1 except that Microball A was not used.

COMPARATIVE EXAMPLE 2

A heat-sensitive recording material was prepared in the same manner as in Example 1 except that the silicone surface active agent was not used.

COMPARATIVE EXAMPLE 3

A heat-sensitive recording material was prepared in the same manner as in Example 1 except that Microball A and the silicone surface active agent were not used.

COMPARATIVE EXAMPLE 4

A heat-sensitive recording material was prepared in the same manner as in Example 6 except that Microball A was not used.

EXAMPLE 10

A heat-sensitive recording material was prepared in the same manner as in Example 1 except that Microball F was used instead of Microball A.

EXAMPLE 11

A heat-sensitive recording material was prepared in the same manner as in Example 1 except that Microball G was used instead of Microball A.

COMPARATIVE EXAMPLE 5

A heat-sensitive recording material was prepared in the same manner as in Example 1 except that no overcoat layer was formed on the intermediate layer.

COMPARATIVE EXAMPLE 6

A heat-sensitive recording material was prepared in the same manner as in Example 1 except that a fluorine-contained surface active agent (Trade name: Fluorad-FC-431, made by Sumitomo 3M Company) was used instead of the silicone surface active agent.

COMPARATIVE EXAMPLE 7

A heat-sensitive recording material was prepared in the same manner as in Example 1 except that a silicone resin powder (Trade name: TOSPEARL 120, made by Toshiba Silicone K.K.) was used instead of the silicone surface active agent.

COMPARATIVE EXAMPLE 8

A heat-sensitive recording material was prepared in the same manner as in Example 1 except that a liquid ethylene-propylene copolymer oligomer having an average moleculer weight of 500 was used instead of Microball A.

The properties of thus obtained heat-sensitive recording materials were evaluated by the following tests. The results are shown in Table 2.

(1) Initial Color Density of Recorded Images

Each of thus obtained heat-sensitive recording materials was recorded by a thermal gradient tester (manufactured by Toyo Seiki Kabushiki Kaisha; testing condition: 120° C., 2 kg/cm$^2$, 10 seconds). The maximum color densities of the recorded images were measured by Macbeth densitometer RD-100R manufactured by Macbeth Corporation.

(2) Gloss

The gloss of the surface of each heat-sensitive recording material was measured by a varied-angle photometer (Glossmeter GM-3D manufactured by Murakami Color Laboratory) at an incident angle of 60°. (The higher the value, the higher the gloss.)

(3) Recording Runnability

Each heat-sensitive recording material was recorded by a full-automatic labeller DP 820 manufactured by Kabushiki Kaisha Ishida Koki Seisakusho and the recording runnability was evaluated by the following criteria.

◎: Recorded with no problem.

○: Recorded with no problem though some stick sound was generated.

Δ: Stick sound was generated, but the recorded images were practical.

X: Stick sound was generated and some poor recording was generated. For example the running of the recording material became partially irregular to produce ununiformly compressed impractical images.

XX: Totally poor recording.

(4) Plasticizer Resistance

A polyvinyl chloride film manufactured by Mitsui Toatsu Chemicals, Inc. was wrapped threefold around a polypropylene pipe having a diameter of 40 mm. A heat-sensitive recording material having a color image recorded by the thermal gradient tester was put on the outer surface in the manner as the color image was exposed outward and further the polyvinyl chloride film was wrapped fivefold around the heat-sensitive record material. The resultant material was allowed to stand for 72 hours and then the color density of the recorded image was measured by Macbeth densitometer RD-100R. The retention value of the color density was calculated. (The higher the value, the better the plasticizer resistance.)

(5) Oil resistance 0.05 cc of salad oil was dropped on the recording layer having a recorded color image and spread uniformly over its surface. The resultant material was allowed to stand for 24 hours and then the color density of the recorded image was measured by densitometer RD-100R. The retention value of the color density was calculated. (The higher the value, the better the oil resistance.)

(6) UV Ink Adhesion

A UV ink-ultraviolet curable ink- (UVS-SEL N-63 Kusa manufactured by Morohoshi Ink Co.) was printed on each heat-sensitive recording material to 0.075 cc/m$^2$ and irradiated with a light from a 80 W high pressure mercury lamp 20 cm apart from the material for 10 seconds to cure the ink and then the ink adhesion was evaluated by Cellophane adhesive tape manufactured by Nitto Denko K.K. peeling in accordance with the following criteria.

◎: The UV ink was completely adhered to heat-sensitive recording material.

○: The ink was peeled off to some extent, but the ink adhesion was practical.

X: About half of the ink was peeled off. The ink adhesion was not practical.

(7) Moisture Resistance

The heat-sensitive recording material having a recorded color image was allowed to stand for 24 hours under a condition of 40° C. and 90% RH and then the color density of the recorded image was measured by Macbeth densitometer RD-100R. The retention value of the color density was calculated.

TABLE 2

| No | Overcoat layer: Micro ball | Overcoat layer: Microball/ Si-surfactant | Initial color density | Gloss | Recording runnability | Plasticizer resistance | Oil resistance | UV ink adhesion | Moisture resistance |
|---|---|---|---|---|---|---|---|---|---|
| Examples | | | | | | | | | |
| 1 | A | 1/0.1 | 1.85 | 95 | ◎ | 100 | 100 | ◎ | 100 |
| 2 | B | 1/0.1 | 1.85 | 95 | ◎ | 100 | 100 | ◎ | 100 |
| 3 | C | 1/0.1 | 1.85 | 95 | ○ | 100 | 100 | ◎ | 100 |
| 4 | H | 1/0.1 | 1.85 | 95 | ○ | 100 | 100 | ◎ | 100 |
| 5 | I | 1/0.1 | 1.83 | 93 | ○ | 98 | 98 | ○ | 95 |
| 6 | A | 5/2 | 1.83 | 92 | ◎ | 98 | 98 | ○ | 95 |
| 7 | A | 0.1/0.02 | 1.85 | 95 | ○ | 100 | 100 | ○ | 100 |
| 8 | E | 1/0.1 | 1.84 | 94 | ○ | 100 | 100 | ◎ | 100 |
| 9 | D | 1/0.1 | 1.85 | 95 | ○ | 100 | 100 | ○ | 100 |
| 10 | F | 1/0.1 | 1.78 | 89 | ○ | 97 | 97 | ○ | 95 |
| 11 | G | 1/0.1 | 1.84 | 94 | Δ | 98 | 98 | ○ | 95 |
| Comparative Examples | | | | | | | | | |
| 1 | — | 0/0.1 | 1.85 | 95 | X X | 100 | 100 | ○ | 80 |
| 2 | A | 1/0 | 1.85 | 95 | X | 99 | 99 | ◎ | 85 |
| 3 | — | 0/0 | 1.85 | 95 | X X | 100 | 100 | ○ | 80 |
| 4 | — | 0/0.1 | 1.85 | 95 | X | 99 | 99 | X | 80 |
| 5 | — | — | 1.30 | 8 | X | 45 | 20 | ○ | 50 |
| 6 | A | 1/0 | 1.82 | 93 | X | 98 | 90 | ○ | 85 |
| 7 | A | 1/0 | 1.72 | 85 | ○ | 88 | 88 | ○ | 85 |
| 8 | — | 0/0.1 | 1.75 | 92 | ○ | 90 | 90 | X | 80 |

As shown in Table 2, the heat-sensitive recording material of the invention is high in recording density and has high gloss and is excellent in preservability and in addition excellent in recording runnability and printability. The heat-sensitive recording material of the invention is also excellent not only in UV ink adhesion but also in ink transfer. Therefore, a higher amount of the ink is transferred to the heat-sensitive recording material to give good finish of print.

What is claimed is:

1. A heat-sensitive recording material prepared by forming on a support successively a heat-sensitive recording layer containing a color former and a color developer which forms a color when reacted with said color former, an intermediate layer obtained by coating an aqueous solution or aqueous dispersion of a resin, and an overcoat layer containing a ionizing radiation curable resin, and then irradiating an ionizing radiation, characterized in that said overcoat layer contains a silicone surface active agent and a low molecular weight polyolefin resin microball.

2. A heat-sensitive recording material according to claim 1, wherein the low molecular weight polyolefin resin microball has a molecular weight of 1,000 to 10,000.

3. A heat-sensitive recording material according to claim 1, wherein the content of the silicone surface active agent is 0.01 to 3 parts by weight and the content of the low molecular weight polyolefin resin microball is 0.05 to 10 parts by weight, respectively, based on 100 parts by weight of the ionizing radiation curable resin.

4. A heat-sensitive recording material according to claim 1, wherein the low molecular weight polyolefin resin microball is prepared from at least one olefin having 2 to 4 carbon atoms.

5. A heat-sensitive recording material according to claim 1, wherein the low molecular weight polyolefin resin microball has a diameter of 0.5 to 7 microns.

* * * * *